US009280964B2

(12) United States Patent
Lin et al.

(10) Patent No.: US 9,280,964 B2
(45) Date of Patent: Mar. 8, 2016

(54) DEVICE AND METHOD FOR PROCESSING SIGNALS ASSOCIATED WITH SOUND

(71) Applicant: Fishman Transducers, Inc., Andover, MA (US)

(72) Inventors: Ching-Yu Lin, Andover, MA (US); Lawrence Fishman, Winchester, MA (US)

(73) Assignee: FISHMAN TRANSDUCERS, INC., Andover, MA (US)

( * ) Notice: Subject to any disclaimer, the term of this patent is extended or adjusted under 35 U.S.C. 154(b) by 55 days.

(21) Appl. No.: 14/211,323

(22) Filed: Mar. 14, 2014

(65) Prior Publication Data

US 2014/0270215 A1 Sep. 18, 2014

Related U.S. Application Data

(60) Provisional application No. 61/784,755, filed on Mar. 14, 2013.

(51) Int. Cl.

| | |
|---|---|
| ***G10H 5/00*** | (2006.01) |
| ***G10H 3/18*** | (2006.01) |
| ***G10H 1/00*** | (2006.01) |

(52) U.S. Cl.

CPC ..... *G10H 3/186* (2013.01); *G10H 1/0091* (2013.01); *G10H 2210/281* (2013.01); *G10H 2220/106* (2013.01); *G10H 2250/111* (2013.01)

(58) Field of Classification Search

CPC ..... G10H 5/002; G10H 1/0091; G10H 3/186; G10H 2210/281; G10H 2220/106; G10H 2250/111

USPC ..... 84/604, 607, 624, 626, 661, 724, 737; 381/17, 22, 61, 63, 66, 71.11, 94.1, 86, 381/103, 318; 704/500, 226; 708/300, 315; 711/100; 375/316

See application file for complete search history.

(56) References Cited

U.S. PATENT DOCUMENTS

| | | | | |
|---|---|---|---|---|
| 4,148,239 | A * | 4/1979 | Oya et al. | 84/605 |
| 4,661,982 | A * | 4/1987 | Kitazato | H03G 5/165 381/103 |
| 4,907,484 | A * | 3/1990 | Suzuki et al. | 84/661 |
| 5,359,146 | A * | 10/1994 | Funaki et al. | 84/624 |
| 5,389,730 | A * | 2/1995 | Wachi | 84/624 |
| 5,418,856 | A * | 5/1995 | Okamoto | 381/17 |
| 5,442,130 | A * | 8/1995 | Kitayama et al. | 84/661 |
| 5,491,755 | A * | 2/1996 | Vogt | H03G 5/005 381/86 |
| 5,532,424 | A * | 7/1996 | Hideo | 84/607 |
| 6,091,894 | A * | 7/2000 | Fujita et al. | 703/13 |
| 6,157,724 | A * | 12/2000 | Kawakami | 381/63 |
| 6,246,773 | B1 * | 6/2001 | Eastty | 381/71.11 |
| 6,252,968 | B1 * | 6/2001 | Narasimhan | H04R 29/00 381/102 |
| 6,256,358 | B1 * | 7/2001 | Whikehart | H03D 5/00 329/315 |
| 6,448,488 | B1 | 9/2002 | Ekhaus et al. | |
| 6,466,912 | B1 * | 10/2002 | Johnston | G10L 19/0204 704/226 |

(Continued)

*Primary Examiner* — Gerald Gauthier

(74) *Attorney, Agent, or Firm* — Pearl Cohen Zedek Latzer Baratz LLP

(57) ABSTRACT

A method and device may color or modify the tone or sound quality of audio input signals. A processor such as a DSP, may apply two or more filters to the audio input signal, each filter comprising a set of filter coefficients. The processor may combine finite impulse response (FIR) filters of the two or more filters into a power-saving filter. A speaker or sound emitter may emitting an output audio signal from the filtered audio input signal. The output audio signal has a different tone quality than that of the input audio signal.

20 Claims, 6 Drawing Sheets

(56) References Cited

U.S. PATENT DOCUMENTS 6,687,669 B1 * 2/2004 Schrogmeier ..... G10L 21/0208 704/200.1
6,696,633 B2 * 2/2004 Miyagishima et al. ..... 84/737
6,721,426 B1 * 4/2004 Kurisu et al. ..... 381/63
7,697,696 B2 * 4/2010 Okumura ..... 381/66
7,734,860 B2 * 6/2010 Sakata ..... 711/100
7,799,986 B2 * 9/2010 Ryle et al. ..... 84/737
7,809,150 B2 * 10/2010 Natarajan ..... H04R 25/453 381/318
7,877,263 B2 * 1/2011 Kauppinen ..... 704/500
7,977,566 B2 * 7/2011 Haddad ..... 84/724
8,143,509 B1 * 3/2012 Robertson et al. ..... 84/604
8,346,835 B2 * 1/2013 Groezing et al. ..... 708/300
8,433,738 B2 * 4/2013 Yamamoto ..... 708/315
8,754,316 B2 * 6/2014 Shimizu ..... 84/626
2007/0019825 A1 * 1/2007 Marumoto et al. ..... 381/94.1
2011/0226118 A1 9/2011 Kuroki
2011/0226119 A1 9/2011 Shinoda
2013/0051563 A1 * 2/2013 Kuroki et al. ..... 381/17
2013/0089209 A1 * 4/2013 Okimoto et al. ..... 381/22
2013/0317833 A1 * 11/2013 Davis ..... 704/500
2014/0270215 A1 * 9/2014 Lin et al. ..... 381/61

* cited by examiner

DEVICE AND METHOD FOR PROCESSING SIGNALS ASSOCIATED WITH SOUND

PRIOR APPLICATION DATA

This application claims the benefit of prior U.S. Provisional Application Ser. No. 61/784,755, filed Mar. 14, 2013, which is incorporated by reference herein in its entirety.

FIELD OF THE PRESENT INVENTION

The present invention directed to sound reproduction and amplification.

BACKGROUND

Embodiments of the present invention are directed to sound reproduction and amplification from musical instruments which produce sound through vibrations. The vibrations may be produced within or about an instrument body, such as the resonance of a stringed instrument, or from the string, bar, membrane, bell or chime of the instrument. Common instruments which use a string to produce a sound include by way of example, without limitation, guitars, banjos, mandolins, violins, cellos, violas, basses, pianos, harps, harpsichords and the like. An instrument with a bar would include by way of example, without limitation, a xylophone. An instrument that uses a membrane to produce a sound would include, without limitation, drums and tympani. An instrument that uses bells or chimes would include, without limitation carillons and glockenspiels.

Musicians desire to color the sounds produced by an instrument to achieve a desired sound heard by a listener.

SUMMARY

It may be useful to have a device capable of modifying the sound produced by a musical instrument to emulate tone qualities such as sound produced from different locations with different acoustics, different instruments, or to add instruments for a richer sound, different sound or special sound effect. Embodiments of the invention provide a method and device to color or modify the tone or sound quality of audio input signals. Audio input signals may include signals from electric (e.g., solid body) or acoustic instruments. One or more filters may be applied to the input signals to produce a different quality than that of the original input signal.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
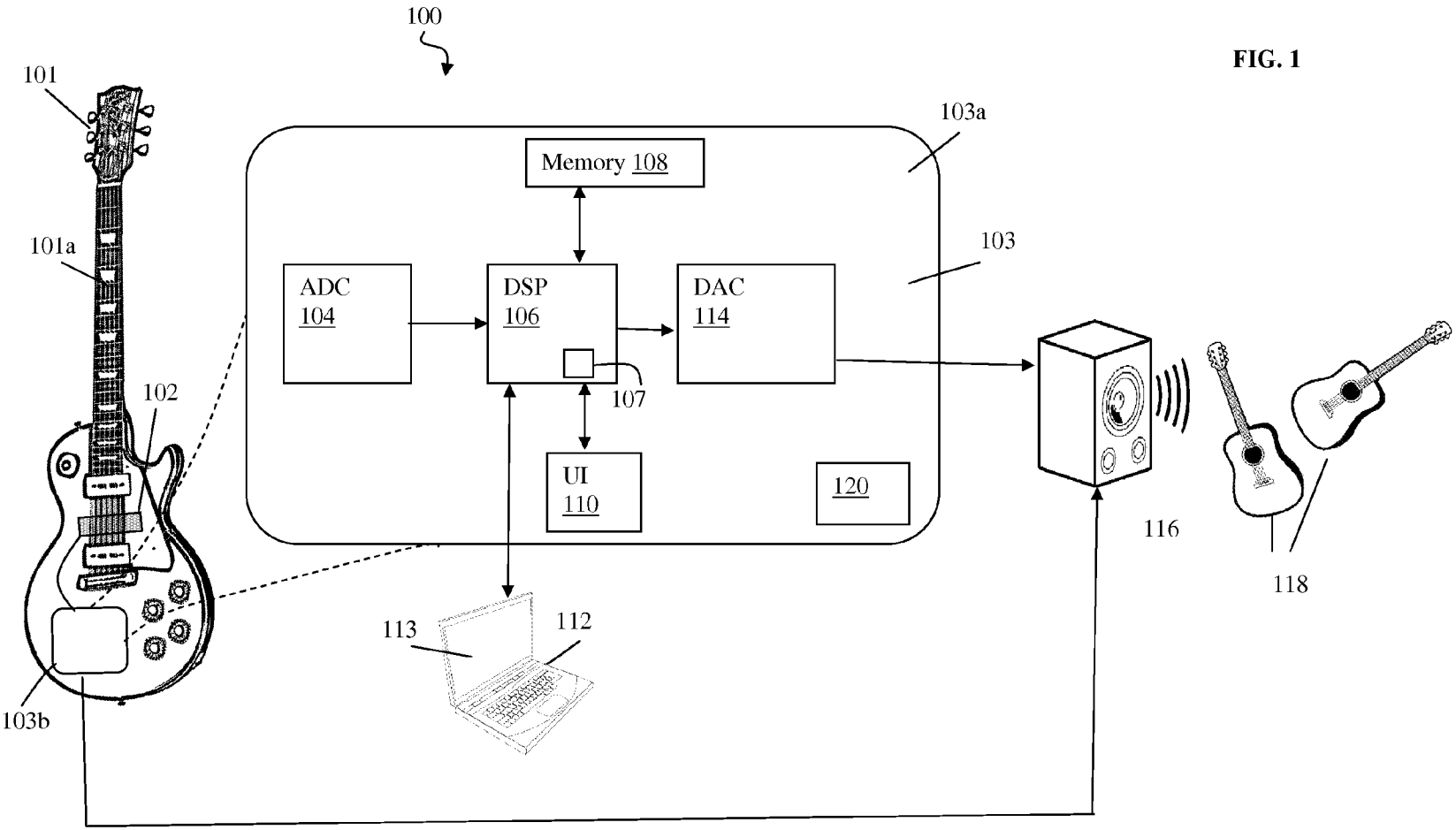
FIG. 1 is a schematic diagram of a system for processing signals associated with sound, according to embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

Embodiment of the present invention will be described in detail with respect to musical instruments, specifically stringed musical instruments, with the understanding that the invention has applications for any instrument in which sound is produced through a vibration element. The features of the invention are subject to alteration and modification and therefore the present description should not be considered limiting.

Acoustic or tone qualities on a stage or in a room may differ according to several factors, including the type of instrument played (electric or acoustic, for example), location in a room (e.g., in a corner of a room or the middle of a room), type of a room (e.g., symphony hall or stadium), and the proximity and spatial relationship among the instruments and between instruments and a microphone. In recording sessions or performance sessions, it may be desirable to reproduce these sounds efficiently and economically. Other types of sounds that one would not normally hear may also be produced by adjusting these factors. Embodiments of the present invention may allow a user, a musician or sound technician, to select instruments and instrument groups in desired ratios, balance, delay and environment to present a desired sound to a listener. The nature of the summing device or section which sums the desired filter coefficients, second processed coefficients and third processed coefficients may be efficient and may not consume large computational capacity or time. Therefore, the sounds may not be subject to undue delays in processing time. And, the power demands of equipment may be maintained at reasonable levels found in places of entertainment, homes and portable devices.

Filters may be designed and implemented which emulate a combination of these acoustic characteristics. For example, an impedance correction filter may change or alter the type of instrument that is played. For a description of an impedance correction filter, see U.S. Pat. No. 6,448,488, incorporated herein by reference. An acoustic transformation filter may, through different sets of filter coefficients, emulate or simulate acoustic qualities of different parts of a room, or different relative proximities to a microphone. Adding delay can emulate a choral or multi-instrument quality by adding slight variation to each sound, and additional slight changes in filter coefficients may emulate the slight differences between each individual's playing style (e.g., one person's vibrato may have different characteristics from another person's vibrato). Through a combination of these filters, it may be possible to emulate surround sound in performance or recording studios using only one or a few instrumentalists. The filter may also allow multi-track or multi-channel recording. Other combinations of filter coefficients may recreate acoustic qualities that are not typically heard, such as a guitar playing a few feet above a microphone, for example.

Embodiments of the present invention may provide a device and method to process, alter or color the sounds or tones produced by a musical instrument to achieve a desired sound heard by a listener. Musical tones may refer to a sound that is characterized by duration, pitch, intensity, and/or timbre. The quality of musical tones may differ even if they have the same pitch and intensity. Other qualities of musical tones may include, for example, its spectral magnitude/phase envelope, time envelope, frequency modulation (vibrato), amplitude modulation (tremolo), or decay time. Embodiments of the present invention may allow a musician or sound technician to modify the sound produced by an instrument to emulate different locations with different acoustics, different instruments, or to add instruments for a richer sound, different sound or special sound effect. For example, embodiments may convert an electric guitar's sound to an acoustic guitar's sound, or to more than one acoustic guitar. In another example, embodiments may convert a violin sound to a viola sound in combination with a cello sound. In yet another example, embodiments may convert an electric guitar's sound at one location of a room to the sound of multiple acoustic guitars in each in different locations of the room. Other sound conversions may be performed. A user interface may allow a user to select (e.g., by providing input) the type of conversion desired.

One embodiment is directed to a device or system for processing signals associated with sound. The system may include a vibration signal input, a signal processor (e.g., a digital signal processor, or DSP), memory, a selectable user interface, and a signal output. The vibration signal input may receive one or more vibration signals from vibrations with from at least one of the group selected from an instrument body, a string, bar, membrane, bell, or chime of a first instrument. The vibration signal input may convert received analog signals into digital signals for the digital signal processor to process. Alternatively, the vibration signal input may receive digital signals from digital sensor(s) on an instrument, a prerecorded digital signal, or a digital sound device such as a synthesizer. The signal processor may be in signal communication with the vibration signal input and may produce processed digital signals. The signal processor may be a digital signal processor or a general purpose computer processor, or a combination thereof, and may convert or process the digital signal from the vibration signal input to a desired sound by applying a filter or combinations of filters and summing functions. As a general purpose computer processor, the dedicated digital signal processor may implement software installed or loaded onto the computer processor. The summing functions may sum filter coefficients from different applied filters. The filters may be implemented as algorithms that alter the frequency response of incoming signals, such as a finite impulse response filter. The memory may be in signal communication with the signal processor and store processed filter coefficients. The memory may store a plurality of alternative sets of filter coefficients that express filters to convert sounds to different instruments or combinations of instruments. The selectable user interface may be in signal communication with the memory and may allow a user to select sets of filter coefficients or specific filter coefficients to apply to vibration input signals.

A power-saving filter blending and sound rendering system may be provided for a first stringed music instrument or other type of instrument to replicate acoustic characteristics from single or multiple other instruments. The system may include at least one sensor on the first stringed instrument that senses the string and body vibration of the said first stringed music instrument; at least one analog to digital converter that converts analog sensor signal of the said first instrument into a digital signal; at least one memory storing coefficients of sound rendering filters that are finite impulse response filter and can transform the digitized sensor signal from the said first instrument into an acoustic sound of a second instrument perceived by a microphone at a certain location; a filter selection interface that has ratio and delay adjust capability for each filter and allows users to select one or multiple filters to be summed; a filter coefficient summing unit that sums the individual coefficients of said selected filters with corresponding ratio and delay amount to form a set of aggregated filters; and a digital signal processing unit that convolves the digitized signal with the said aggregated filter coefficients and output or emit the processed digital signal to a digital-to-analog converter. The sound rendering filter coefficients may be the result of the convolution between the coefficients of an acoustic transformation filter and an impedance correction filter. The acoustic transformation filter may be a finite impulse response filter that transforms the sensor signal of a second instrument to the microphone signal of the said second instruments in a certain location. The impedance correction filter may be a finite impulse response filter that compensates for the difference in sensor mounting impedance between the said first and second instruments and corrects the sensor response of the said first instrument to match the sensor response of the said second instruments as if the sensor of the said first instrument is installed on the said second instrument. The acoustic transformation filter and impedance correction may also be a bypass filter. A filter coefficient summing or convolving function may produce one or more than one sets of filter coefficients and the signal processing unit may produce one or more than one outputs of surrounding sound. A filter selection interface may be a graphical user interface that allows users to place the selected instruments relative to the microphone on a two dimensional or three dimensional map.

As used herein, the term "vibration signal" refers to any electromagnetic or optical signals that are received or produced in response to vibration. For example, some embodiments of the present invention may use a vibration signal that may be produced or received via wires, infrared communication devices, WiFi-type devices, or radio communication. The vibration itself may be sensed optically, acoustically or electromechanically by devices such as a microphone, strain gauge, hall-effect sensor, laser, coil pick-up and acceleration or piezoelectric sensor, and converted to a vibration signal input. The vibration signal may be input to an analog-to-digital converter (ADC) that converts analog signals from the instrument, e.g. analog current, to digital signals that are able to be filtered into converted sounds, e.g., a converted audio signal. The analog signal may be fed into ADC or other device through a pickup found on an electronic instrument, for example.

As used herein, the term "signal processor" refers to devices and components which may, for example, receive a vibration signal and apply filters having coefficients capable of being stored electronically or digitally. The signal processor may process the digital signals to form a converted or processed digital signal (e.g. representing or being a converted audio signal), using for example sets of filter coefficients stored in memory. The filter coefficients may comprise information digitally encoded regarding the sound of an instrument to be emulated.

One embodiment of the present invention includes a signal processor having one or more finite impulse filters. As used herein, the term "memory" refers to computer or computer like memory features represented by core, main memory, primary, secondary, tertiary, internal, external, such as hard drives, flash drives and the like readable and accessible by computer processing units (CPUs) and computers. The sets of filter coefficients may include filter coefficients that relate to converting sounds to a particular quality, instrument or color of sound. The qualities or tone qualities of sound may be for example an instrument-type quality, an acoustic quality, a multi-instrument quality, or a combination of qualities. The acoustic qualities may be created from a simulated location within a room or a simulated location relative to one or more microphones. The alternative sets of filter coefficients may be created by storing filter coefficients generated or created by a first instrument in a first location to be used at a second location, for example, when particular acoustic features of a first location are desired, synthesized, or developed in controlled environments such as a recording studio, or are filter coefficients representing instruments different from the first instrument. The different sets of filter coefficients may be present in memory or may be added to memory by downloading from outside sources such as a computer readable disk, external memory devices or from internet sources.

Some embodiments of the invention may include a graphic display, computer screen, or handheld device such as a smartphone, which displays the choices of filter coefficient sets, and in response to the user selections made by mouse or key stroke or by touch or other means, the computer or device effects a summing of selected filter coefficients in a desired ratio. For example, one embodiment of the invention features a summing function which may add time delay to signals in order to create features of reverberation, multiple instruments, and depth.

Some embodiments of the invention may include a power source in electrical communication with a vibration signal input device, a signal processor, memory and a selectable user interface. The signal processor, memory and selectable user interface may be powered by the power source to perform the summing of coefficients and output of a converted output signal. The signal processor may sum the selected signal coefficients and form an acoustic output signal efficiently. This efficient processing of the vibration signal to the acoustic output signal may allow the device to have a low power draw, as much as one tenth the power draw of other sound blending systems. The power source may be portable and may be integrated into the device. The device may be mounted to the first instrument such as a guitar or guitar-like structure or frame or clipped onto clothing or strapped onto the user's body by belts. One power source may comprise one or more batteries.

A further embodiment may include a step of selecting signal coefficients in a desired ratio. An embodiment of the method may include selecting a desired delay capability to create features of reverberation and depth. A further embodiment may include the step of selecting a positional relationship of a first instrument, second instrument and third instrument. A graphical display may be used to facilitate the user selections.

FIG. 1 is a schematic diagram of a system for processing signals associated with sound, according to embodiments of the invention. An instrument or musical instrument, such as an electric guitar 101 (other instruments may be used), may have its sound converted to a different tone or tone quality by system 100 (e.g., to a converted audio signal). A conversion device 103 may convert analog signals, for example, from electric guitar 101 to a converted audio signal that may be played or performed by an output device, such as a sound emitter or speaker 116. The conversion device may be external 103*a* to the electric guitar 101 or may be directly mounted 103*b* on the electrical guitar 101. The electric guitar 101 may include a pickup device 102 or other vibration sensor to sense vibrations from the electric guitar 101 when it is played. The pickup device 102 may be a coil pickup, for example, with magnetic rods that create a magnetic field near the guitar's strings 101*a*. When the guitar's strings 101*a* are played, the vibration of the strings may change the magnetic field of the pickup and induce a current or analog signal. The pickup device 102 may send the analog signal to a vibration signal input device 104, which may include circuitry to convert analog signals to digital signals. The digital signal output or emitted from the vibration signal input 104 may be sent to a digital signal processor 106. The digital signal processor 106 may apply or use FIR filters 107 and summing functions to convert the electric guitar's 101 sound to a different instrument's sound or to a multiple instruments sound. Filter 107 may be a digital or analog circuit or algorithm implemented by software that can process or change the frequency response of an input signal. The filter 107 may be defined by a set of filter coefficients that affect the weighting of an output signal's spectrum. The digital signal processor 106 may retrieve sets of filter coefficients from memory 108.

The sets of filter coefficients may relate or correspond to different instruments or types of sound. For example, one set of filter coefficients may correspond to an acoustic sound or percussive sound, or another set may correspond to an instrument such as a violin. Different sets of filter coefficients may correspond to different acoustic characteristic present in various locations in a room. The sets of filter coefficients may be pre-loaded to memory 108 and may be determined from pre-recorded studio sessions, for example. Memory 108 is preferably capable of receiving further alternative sets through communication through data ports such as Music Instrument Digital Interface (MIDI) ports, USB type ports or wireless data communication devices, such as Wi-Fi, known in the art. The sets of filter coefficients may be fixed in memory or capable of being erased, modified or substituted. The sets of filter coefficients may be combined, for example, to be more computationally efficient than processing an input signal with individual sets of filter coefficients. Processor 106 may be configured to carry out methods as disclosed herein for example by being operatively connected to memory 108, configured to store software and data (e.g., coefficients), where the processor carries out the software instructions, or in the case processor 106 is a dedicated processor performs operations according to its configuration.

Alternatively, the filter coefficients themselves may be set or adjusted by for example a computer 112 or user interface 110. User interface 110 may in some cases include or be part of a display 113, such as a monitor or touchscreen, and/or an input device or devices, such as a keyboard, mouse, or touchscreen. User interface 110 may allow a user to select or adjust two or more sets of filter coefficients to apply to or use on an input sound, and/or may allow display of information to a user. E.g., interface 110 may produce a graphical user interface (GUI). The user interface 110 may further allow adjustment of delay and other parameters. The user interface 110 may be integrated with conversion device 103 or may be a separate device, such as a smart phone, tablet, or computer 112 via wireless communication. Once the two or more filters are applied to an input digital signal it may be sent to a processed signal output 114. The two or more filters may be applied to the input digital as a single, combined filter. The processed signal output device 114 may be a digital-to-analog converter (DAC) to convert the processed digital signal to an analog signal that can be emitted, output, or played by a sound emitter or speaker 116 or other sound output device. The sound that is output or emitted by the speaker 116 may emulate or sound like multiple acoustic guitars 118, for example, and may have a different tone quality than that of the input audio signal. Alternatively, the processed signal output may be a digital signal that is sent to a speaker.

Filter coefficients or transfer functions may be used in commercially available products. Examples of such products are marketed by Fishman Transducers, Inc. (Andover, Mass., USA) under the trademark AURA® and AURA® IC. These products may employ one or multiple filters to correct or modify impedance, transform signal coefficients to correspond to a chosen microphone or location, transform the signal coefficients to that of a chosen instrument, manipulate the components of the sound through equalization and phase shifting, alter or modify sound decay, delay and gain. See also US Patent Application Publications US 2011/0226118 and US 2011/0226119, incorporated herein by reference in their entirety.

One type of filter according to embodiments of the invention may be a finite impulse response (FIR) filter performing a convolution or mathematical summing of input signal vectors and coefficient vectors in the time domain, represented by filter coefficients. In a general mathematical form, the output of a filter y[n] may be the convolution of the input vector x and the coefficient vector h, may be represented by the expression:

$$y[n]=\text{sum}(x[j]*h[i]),\ \text{for all } i+j=n,$$

where x[n] is the input.

With the special property of FIR filters, individual FIR filters or signal coefficients of multiple FIR filters may be summed with particular ratios (determined by users in real time or beforehand) into, for example, one or more power-saving filters and the resulting filter coefficients may be stored in memory (e.g., memory 108 in FIG. 1). For example, each of the individual FIR filters or sets of signal coefficients y1[n] to yp[n] can be expressed as set forth below:

$$y1[n] = \text{sum}(x[j] * h1[i]),\ \text{for all } i + j = n;$$

$$y2[n] = \text{sum}(x[j] * h2[i]),\ \text{for all } i + j = n;$$

$$\ldots$$

$$yp[n] = \text{sum}(x[j] * hp[i]),\ \text{for all } i + j = n;$$

where p is the number of sounds to be combined.

Once the ratios of each sound are determined by users and a group of individual sounds are selected by users (e.g., through a user interface such as that shown in FIG. 4), the coefficients of a single combined FIR filter implementing multiple individual FIR filters may be determined by the expression:

$$h[i]=q1*h1[i]+q2*h2[i] \ldots qp*hp[i]; \quad [1]$$

where q1, q2 . . . qp are the ratio for each sound to be combined and q1+q2+ . . . qp=1.

The final output may be expressed as:

$$Y[n]=\text{sum}(x[j]*h[i]),\ \text{for all } i+j=n; \quad [2]$$

which may utilize a smaller amount of computational power, compared to a method using multiple device or FIR filters. The power saving ratio may be for example lip.

A mixer and multiple devices may be used to blend or mix the resulting filtered signals to achieve the desired sound. These multiple devices may use infinite impulse response (IIR) filters or finite impulse response (FIR) filters or both, which may require more power than a single device with a single FIR filter. IIR filters may have impulse responses that do not dissipate to exactly zero after a certain time t, whereas FIR filters may have impulse responses that become exactly zero after time t. Embodiments of the invention may integrate the functions of the mixers and other devices into one device that combines FIR filters. Alternatively, embodiments using combinations of both FIR and IIR filters may be used.

In general, multiple FIR filters connected in a parallel circuit may be efficiently combined into a combined, power-saving filter by, for example, summing the coefficients for the individual FIR filters. The combined filter may save power by for example, performing fewer computations, steps or calculations than if the FIR filters individually processed an input signal. When FIR filters are connected in parallel, they may be driven by the same input signal, and the outputs from each of the FIR filters may be summed. In contrast, when FIR filters are connected in a series circuit, the output of one filter may be the input of a subsequent filter. The filter coefficients of the multiple FIR filters in series may be combined by convolving the filter coefficients of each individual FIR filter, which may not save computation steps (which may be directly related to power). By combining the parallel FIR filters into, for example, one or more filters, computational power may be saved through summing or adding the coefficients. However, multiple BR filters or a mix of BR and FIR filters may not be combinable into a single filter that saves computational power. This may be because the transfer function of BR filter includes a denominator that may increase computational complexity when added with other filters. In comparison, FIR filters may be more easily combined with other FIR filters due to their simpler transfer function having no terms in the denominator. The mixer or combining unit, and thus the combined filter, may, for example, be part of the DSP 106 or may, for example, be part of the separate computing device 112 which can load the combined power-saving filter onto the DSP 106 and store them in memory 108.

The power demands for summing functions, such as the finite impulse filter described, may be accommodated by portable electrical power sources. Device 104 may have a portable power source in the form of a battery 120.

In some embodiments, a device such as device 103 can be integrated or mounted into a body of an instrument, such as a guitar, violin, cello and the like, or merely clipped to an article of clothing worn by the user or hung on a strap or belt or bracelet or held in a pocket. Although described as a unitary device, features of the device 103 may be held in discrete sub-units which communicate through wires or wireless communication in the nature of Wi-Fi. For example, embodiments of the present invention may be implemented in a smart phone or other device with a graphical user interface, which is separate from the instrument. The smart phone may be able to send user settings to a device mounted on the instrument (e.g., act as a user interface such as that shown in FIG. 4), or alternatively, the smart phone may have signal processing capability as described herein. The smart phone may communicate wirelessly with a module or device on the instrument.

Figure 2:
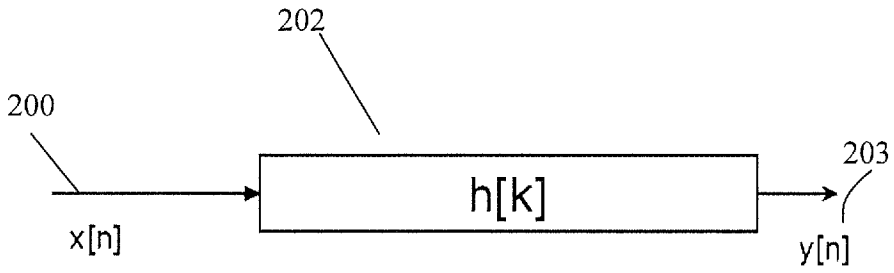
FIGS. 2 and 3 are block diagrams of the processes used to convert digital signals in a device, according to embodiments of the invention.
Figure 3:
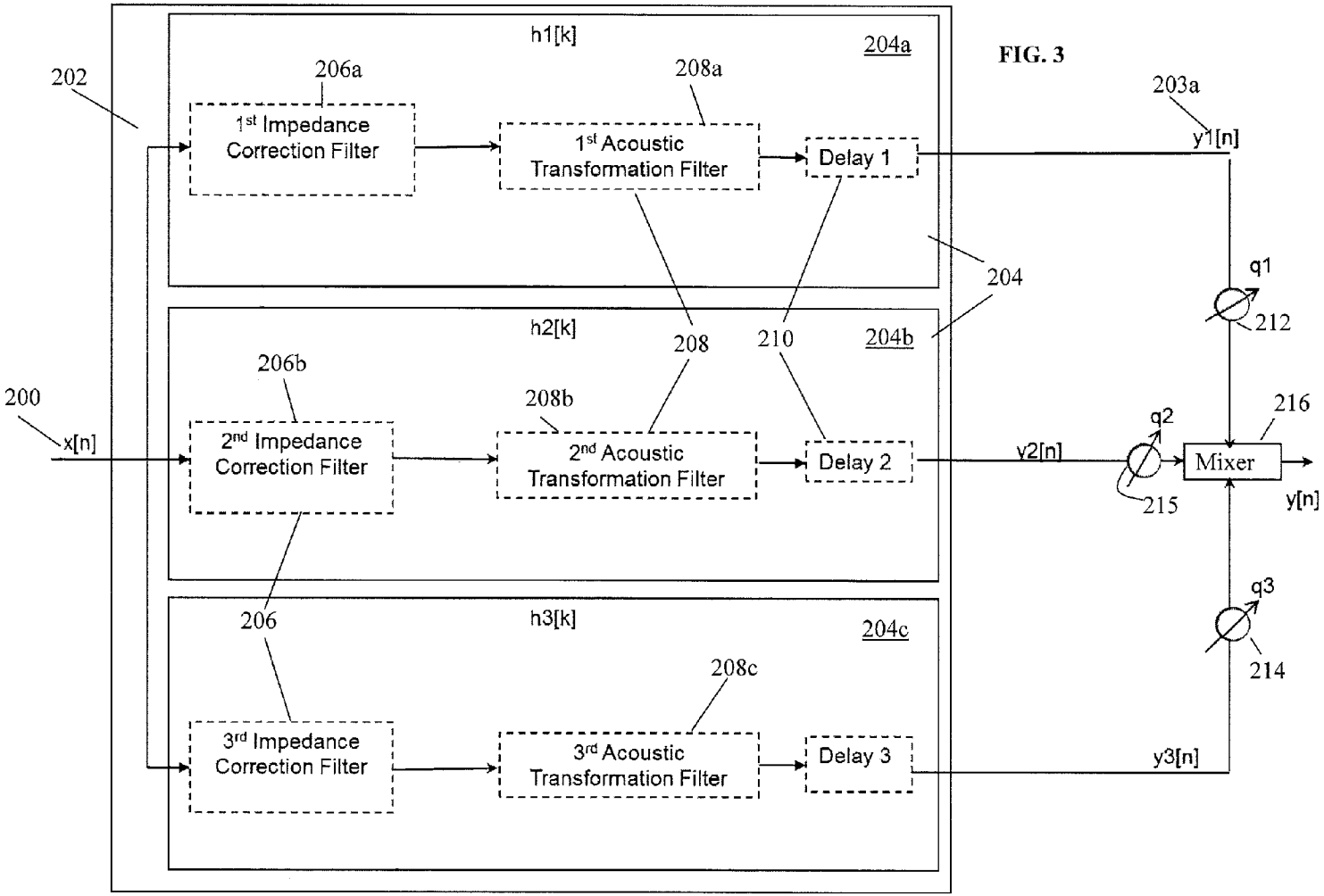

FIGS. 2 and 3 are block diagrams of filters used to convert digital signals in a device, according to embodiments of the invention. In FIG. 2, a simplified, high-level illustration of a filter's transfer function, a filter's transfer function may be represented by h[k] 202 and may be implemented by (and thus may in some embodiments be considered to be) a digital signal processor (e.g., DSP 106) or other processor, for example. Input signal x[n] 200 may be a digital signal from an electric instrument such as an electric guitar (e.g., electric guitar 101). The digital signal may include information about the electric instrument's sounds and vibrations created by the instrument's user. The transfer function h[k] 202 may combine multiple different sounds such as a first instrument (which may be the same as the input instrument), a second instrument, and a third instrument, for example, as shown in reference FIG. 3's sub-filters 204*a*, 204*b*, and 204*c*, respectively. Output signal y[n] 203 may be the result of transfer function h[k] 202 being applied to input signal x[n] 200. Output signal y[n] may be sent or transmitted to an audio speaker, for example, or a synthesizer for further processing. Transfer function h[k] 202 may be a combined power-saving filter that combines multiple other filters that are more fully described below.

In FIG. 3, a more detailed filter h[k] 202 may include two or more sub-filters 204. Each sub-filter 204 may be connected in parallel and provide a different output signal in a different voice, based on the same input signal. For example, each sub-filter 204 may include an impedance correction filter 206 to change a type of instrument sound, an acoustic transformation filter 208 to give an input signal acoustic sound qualities, and a delay filter 210 to add time delay to each voice so that the combined voices may have a choral or multi-instrument quality. Each sub-filter's characteristics may be adjusted or changed by a user through a user interface (e.g., user interface 400 in FIG. 4). The sub-filters may include other kinds of transformation functions or filters. Filter h[k] 202 may be programmed or adjusted to transform an input signal x[n] 200 into three distinct voices, for example. Since the impedance correction filter 206, acoustic transformation filter 208, and delay filter 210 may be connected in series, their filter coefficients may be combined by convolution. A first sub-filter 204*a* may transform an electric instrument's input (e.g., input from an electric guitar) to a first output signal y1[n] 203*a*. A processor (e.g., processor 106 in FIG. 1) may be programmed with a filter or algorithm to output a first output signal y1[n], for example, to sound similar to the electric instrument's original sound. Thus a processor such as processor 106 may be configured to be a filter by, for example including specialized circuitry and/or executing instructions which when executed cause the processor to function as a filter, and perform other aspects of methods according to the present invention. In this case, the first impedance correction filter 206*a* may optionally be bypassed, since the output may include the input instrument's sound. An acoustic transformation filter 208*a* may transform the audio signal from an electric instrument to a signal with more acoustic-sounding qualities at a simulated location, such as three feet from a microphone in a recording studio. A second sound rendering filter 204*b* may transform an input signal x[n] 200 to an acoustic sound of a second instrument such as a violin, using a second impedance correction filter 206*b*. A second acoustic transformation filter 208*b* may further change the acoustic quality of the input signal by providing filter coefficients that would place the violin sound at a simulated or virtual location such as a concert hall. A third sound rendering filter 204*c* may transform the first input signal to an acoustic sound of a third instrument, such as a cello. The third sound rendering filter 204*c* may include a third impedance correction filter 206*c* to transform the input signal into a cello sound and a third acoustic transformation filter 208*c* to provide a dampened acoustic quality, for example. Other instruments or combinations of instruments may be used.

For each of these filters (e.g., 204*c*, 204*b*), a set of filter coefficients may be retrieved from memory that includes the effects of an impedance correction filter 206, an acoustic transformation filter 208, a delay filter 210, or other effects. The filters may be in series to capture multiple sound effects into one instrument. In series, the filters' set of filter coefficients may be convolved. The filters may also be combined into a power-saving filter by summing the filters that are connected in parallel (e.g., receiving the same input) to capture multiple instruments or voices in the output. For example, the filter coefficients of sub-filters 204*a*, 204*b*, and 204*c* may be summed. The sounds from each filter may be blended or mixed, for example, by summing or convolving the coefficients in a processor 106 in FIG. 1. To have a chorus-like quality, the signal processor may introduce delay 210. The three sounds may have different weights or proportions in power or amplitude and they may have a ratio of q1, q2, and q3 respectively, for example. The proportions may be implemented by potentiometers 212, 214, 215 or other devices. Other numbers of sounds or instruments may be processed.

Mixer 216 (e.g., implemented in DSP 106 in FIG. 1) may sum or convolve the coefficients for all the parallel FIR filters (e.g., using equation [2] above) into a combined power-saving FIR filter and may individually process input signals for IIR filters. For example, sub-filters 204*a*, 204*b*, 204*c* may each be implemented by FIR filters. Mixer 216 may convolve the filter coefficients in a sub-filter (e.g., convolve the coefficients of the second impedance correction filter, second acoustic transformation filter, and delay) and sum the sub-filters into a single, combined filter with transfer function h[k] (see, e.g., transfer function h[k] in FIG. 2) that is computationally more efficient than the processing of three individual sub-filters. A power-saving filter may be implemented by summing any number of sub-filters using selected ratios (e.g., q1 and q2).

Figure 4:
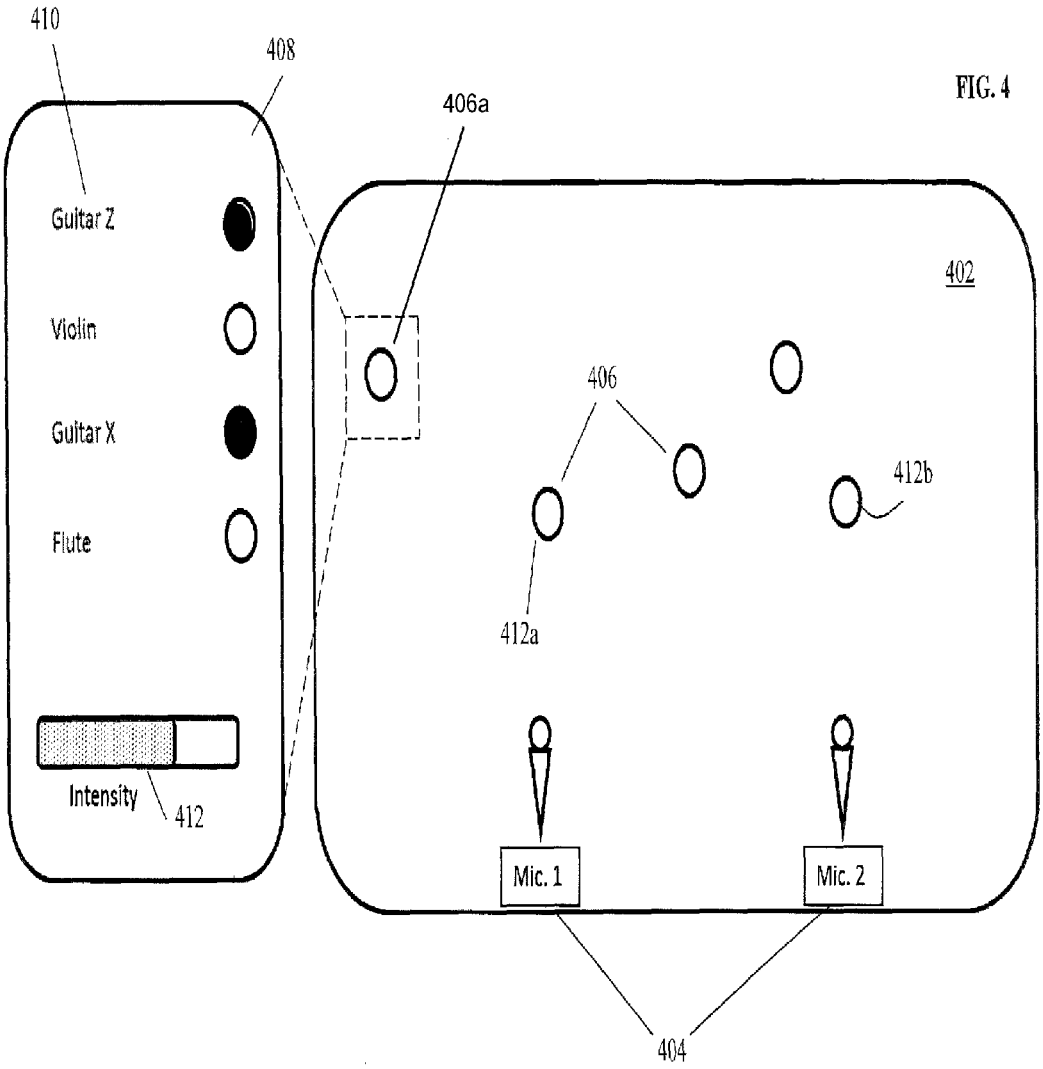
FIG. 4 is a diagram of a user interface, according to embodiments of the invention.

FIG. 4 is a diagram of a user interface 400, according to embodiments of the invention. The user interface 400 may be displayed or produced on a touchscreen device, monitor, or other device, for example interface 110. A displayed filter representation may allow an instrumentalist to emulate different instruments 406 with the acoustics of a simulated room or stage 402. A user may select two microphones 404, for example, in a simulated room 402. The acoustics of the sound produced in the room 402 may have different qualities depending on the location of the instrument in relation to the microphones 404. A user may place instruments 406 in different parts of the room 402. For each instrument 406, a menu 408 may appear which may allow a user to select a brand or type 410 of instrument, of a combination of brands or types. For example, a user may select one location 406*a* to have a combination sound of Guitar X and Guitar Z. The user may further adjust the intensity 412 of the sound in that location. For each instrument 406, a processor (e.g., processor 106 of FIG. 1) may retrieve from memory (e.g., 108 of FIG. 1) a set of filter coefficients to emulate the instrument's type and location in a room. The processor may combine the filters in an efficient manner or add delay to create a choral effect. For example, the processor may combine the selected sets of filter coefficients to a combined power-saving filter.

In some embodiments, filters may be combined into more than one power-saving filter to create surround sound, for example. An input sound may be converted to a first output sound with a violin sound and a cello sound at one position relative to a first microphone. The same input sound may be converted to a second output sound with a violin and a cello sound at another position relative to the same microphone or a second microphone. Each output may be the result of applying a combined power-saving filter, and may each be emitted to a different speaker (e.g., a right and left speaker). For example, a user may select an instrument 412*a* to have an output of a violin and cello at a location relative to microphones. The output signal may be transmitted to a left speaker. The user may also select a second instrument 412*b* to transform the same input as the first instrument 412*a* into an output of a violin and cello at a different location relative to the first and second microphones 404. The output signal may be transmitted to a right speaker. Different power-saving filters may be applied to first instrument 412*a* and 412*b* which capture the different positions relative to microphones 404. Other combinations may be possible. From a single input signal from an instrument, multiple outputs may be generated or created based on variations in the combinations of filters or sub-filters. The difference between each of the multiple outputs may, for example, be based on the different simulated locations related to microphones or different simulated locations in a space. Other variations or differences between multiple outputs may be possible.

Figure 5B:
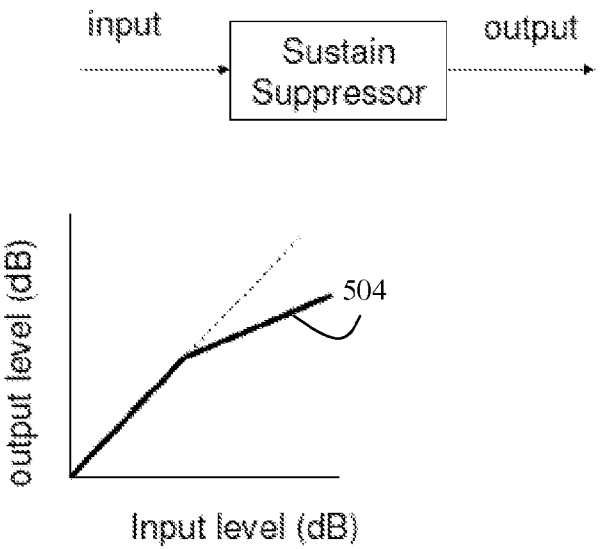
FIGS. 5A and 5B are schematic diagrams of a system of signal processing, according to embodiments of the invention.
Figure 5A:
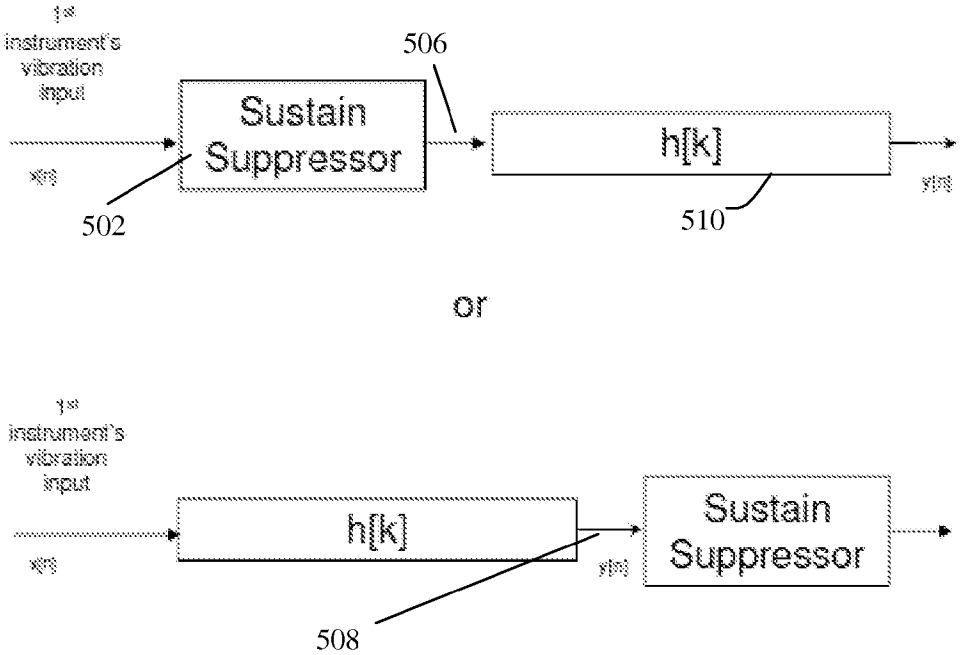

FIG. 5A is a schematic diagram of a signal processing system, according to embodiments of the invention. Embodiments of the inventions may include, or effect filters which include, a sustain suppressor 502 to better emulate acoustic tone qualities. Electric instruments, such as electric guitars or violins, may have a tendency to sustain longer than acoustic instruments. In order for electric instruments to have their sounds "die down" quicker, like an acoustic instrument, sustain suppressor 502 may dampen the amplitude of output power, as shown in the graph 504 of FIG. 5B. Sustain suppressor 502 may be placed before 506 or after 508 a device implementing filter h[k] 510.

The processing of signals in accordance with the expressions set forth above can be performed in one or more impedance filters and/or acoustic transformation filters or combination of both. The processing of signals is not limited to replicating sound filters but also applies to all general finite impulse response filters.

The user may further perform a step of selecting filter coefficients in a desired ratio. The user may perform the step of selecting a desired delay capability to create features of reverberation and depth. The user may also perform the step of selecting a positional relationship of multiple instruments, or positional relationship between the instruments and the microphone.

Figure 6:
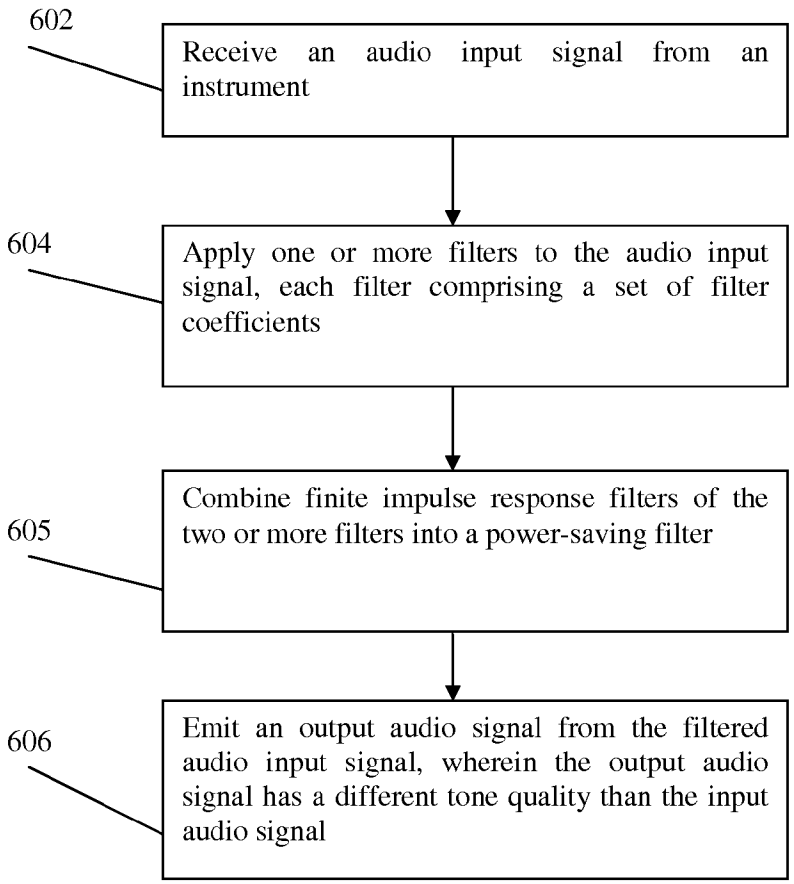
FIG. 6 is a method of sound processing, according to embodiments of the invention.

FIG. 6 is a flow chart describing a method of signal processing, according to an embodiment of the invention. In operation 602, a processor may receive an audio input signal from an instrument such as an electric guitar or acoustic violin or saxophone, for example. The audio input may be sensed by a pickup device that converts vibrations from the instrument and converts them into electrical signals, for example. In operation 604, the processor may apply one or more filters to the audio input signal, the filter for example including or being defined by a set of filter coefficients. The filter may convert or alter the input signal so that it changes the quality, tone or color of the audio signal's sound. The filter may for example further introduce delay into multiple signals so as to create a choral-like quality. In operation 605, the processor may combine finite impulse response filters of the two or more filters into for example a single filter. The combined filter may have a power saving ratio of 1/p. In operation 606, the processor may emit or output an output audio signal from the filtered audio input signal, wherein the output audio signal has a different tone quality than the tone quality of the input audio signal. The same input signal may have multiple combined filters applied to it, which may produce multiple output audio signals. The multiple output signals may each be assigned or transmitted to different speaker devices, or other output devices. In other words, embodiments of the invention may have a single input with multiple outputs.

In some embodiments filters may be combined into a single filter. In other embodiments, filters may be combined into multiple filters. The multiple filters may each apply a different tone quality to an input signal, producing an output signal that has a different tone quality from the input signal. Further, the multiple output signals may each differ from each other in tone quality. The difference in tone quality for each of the multiple output signals may be based on, for example, different simulated locations relative to one or more microphones. Other differences in tone quality may be possible. The multiple output signals may each be transmitted or emitted to different outputs, such as different speakers.

Embodiments of the invention may include an article such as a computer or processor readable non-transitory storage medium, such as for example a memory, a disk drive, or a USB flash memory device encoding, including or storing instructions, e.g., computer-executable instructions, which when executed by a processor or controller, cause the processor or controller to carry out methods disclosed herein. Some embodiments may include a combination of one or more general purpose processors and one or more dedicated processors such as DSPs.

Thus, embodiments of the present invention have been described with respect to what is presently believed to be the best mode with the understanding that these embodiments are capable of being modified and altered without departing from the teaching herein. Therefore, the present invention should not be limited to the precise details set forth herein but should encompass the subject matter of the claims that follow and the equivalents of such.

What is claimed is:

1. A sound-processing method, comprising:

receiving an audio input signal from a musical instrument;

applying two or more filters to the audio input signal, each filter comprising a set of filter coefficients;

combining finite impulse response (FIR) filters of the two or more filters into a power-saving filter; and emitting an output audio signal from the filtered audio input signal, wherein the output audio signal has a different tone quality than that of the input audio signal.

2. The sound-processing method of claim 1, wherein combining finite impulse response filters comprises summing filter coefficients of parallel finite impulse response filters.

3. The sound-processing method of claim 1, wherein the tone quality comprises at least one of an acoustic quality, instrument-type quality, or a multi-instrument quality.

4. The sound-processing method of claim 3, wherein the acoustic quality is determined by a simulated location within a room.

5. The sound-processing method of claim 3, wherein the acoustic quality is determined by a simulated location relative to one or more microphones.

6. The sound-processing method of claim 1, wherein applying the two or more filters comprises applying the power-saving filter to the audio input signal.

7. The sound-processing method of claim 1, wherein the one or more filters includes an impedance correction filter.

8. The sound-processing method of claim 1, comprising combining infinite impulse response (BR) filters and finite impulse response filters into a single filter.

9. The sound-processing method of claim 1, comprising emitting a plurality of output audio signals with a different tone quality than that of the input audio signal, wherein each of the plurality of the output audio signals differs from each other based on an acoustic quality determined by a simulated location relative to one or more microphones.

10. The sound-processing method of claim 1, comprising selecting, by a user, an instrument-type, acoustic, or multi-instrument quality for the output audio signal to emulate.

11. A sound processing system, comprising:

a memory configured to store one or more sets of filter coefficients; and a processor configured to:

receive an input audio signal from an instrument;

apply two or more filters to the input signal, using the one or more sets of filter coefficients;

combine finite impulse response filters of the two or more filters into a power-saving filter; and output a converted audio signal to a sound emitter, wherein the converted audio signal has a different tone quality than that of the input audio signal.

12. The sound processing system of claim 11, wherein the tone quality comprises an acoustic quality determined by a simulated location within a room, a simulated location relative to one or more microphones, or both.

13. The sound processing system of claim 11, wherein the two or more filters include a sustain suppressor.

14. The sound processing system of claim 11, wherein the acoustic quality is determined by a simulated location relative to one or more microphones.

15. The sound processing system of claim 11, wherein the tone quality comprises an instrument-type quality.

16. An apparatus, comprising:

a vibration signal input to receive a signal from an instrument and convert it to a digital signal;

a memory to store two or more sets of filter coefficients;

a user interface to allow a user to select two or more sets of filter coefficients from the memory; and a signal processor to apply the selected set of filter coefficients to the converted digital signal.

17. The apparatus of claim 16, wherein the applied set of filter coefficients provide to the converted digital signal a different tone quality than the tone quality of the received signal from an instrument.

18. The apparatus of claim 17, wherein the different tone quality comprises an acoustic quality determined by a simulated location relative to one or more microphones.

19. The apparatus of claim 16, wherein the one or more sets of filter coefficients include coefficient for an impedance correction filter.

20. The apparatus of claim 16, wherein the signal processor is to combine the selected sets of filter coefficients into a power-saving filter.

* * * * *

UNITED STATES PATENT AND TRADEMARK OFFICE

CERTIFICATE OF CORRECTION

PATENT NO. : 9,280,964 B2
APPLICATION NO. : 14/211323
DATED : March 8, 2016
INVENTOR(S) : Ching-Yu Lin et al.

It is certified that error appears in the above-identified patent and that said Letters Patent is hereby corrected as shown below:

In the specification,
In column 7, lines 59-61 should read: --
which may utilize a smaller amount of computational power, compared to a method using multiple device or FIR filters. The power saving ratio may be for example 1/p.

In column 8, lines 7-35 should read: --
In general, multiple FIR filters connected in a parallel circuit may be efficiently combined into a combined, power-saving filter by, for example, summing the coefficients for the individual FIR filters. The combined filter may save power by for example, performing fewer computations, steps or calculations than if the FIR filters individually processed an input signal. When FIR filters are connected in parallel, they may be driven by the same input signal, and the outputs from each of the FIR filters may be summed. In contrast, when FIR filters are connected in a series circuit, the output of one filter may be the input of a subsequent filter. The filter coefficients of the multiple FIR filters in series may be combined by convolving the filter coefficients of each individual FIR filter, which may not save computation steps (which may be directly related to power). By combining the parallel FIR filters into, for example, one or more filters, computational power may be saved through summing or adding the coefficients. However, multiple IIR filters or a mix of IIR and FIR filters may not be combinable into a single filter that saves computational power. This may be because the transfer function of IIR filter includes a denominator that may increase computational complexity when added with other filters. In comparison, FIR filters may be more easily combined with other FIR filters due to their simpler transfer function having no terms in the denominator. The mixer or combining unit, and thus the combined filter, may, for example, be part of the DSP 106 or may, for example, be part of the separate computing device 112 which can load the combined power-saving filter onto the DSP 106 and store them in memory 108.

In the claims,
In column 12, lines 56-58 should read: --
8. The sound-processing method of claim 1, comprising combining infinite impulse response (IIR) filters and finite impulse response filters into a single filter.

Signed and Sealed this
Twelfth Day of July, 2016

Michelle K. Lee

Michelle K. Lee
*Director of the United States Patent and Trademark Office*